US010881146B2

(12) United States Patent
Qiu

(10) Patent No.: US 10,881,146 B2
(45) Date of Patent: Jan. 5, 2021

(54) ELASTIC LOCKING MECHANISM FOR ELECTRONIC CIGARETTE, ATOMIZER, AND ELECTRONIC CIGARETTE

(71) Applicant: JOYETECH EUROPE HOLDING GMBH, Zug (CH)

(72) Inventor: Weihua Qiu, Jiangsu (CN)

(73) Assignee: JOYETECH EUROPE HOLDING GMBH, Zug (CH)

( * ) Notice: Subject to any disclaimer, the term of this patent is extended or adjusted under 35 U.S.C. 154(b) by 314 days.

(21) Appl. No.: 15/994,283

(22) Filed: May 31, 2018

(65) Prior Publication Data

US 2018/0271174 A1 Sep. 27, 2018

Related U.S. Application Data

(63) Continuation-in-part of application No. PCT/CN2017/070956, filed on Jan. 12, 2017.

(30) Foreign Application Priority Data

Jan. 18, 2016 (CN) ..... 2016 1 0031195
Mar. 31, 2016 (CN) ..... 2016 1 0197619

(51) Int. Cl.
*A24F 13/00* (2006.01)
*A24F 17/00* (2006.01)
(Continued)

(52) U.S. Cl.
CPC ..... *A24F 47/008* (2013.01); *A24F 40/00* (2020.01); *A24F 40/49* (2020.01)

(58) Field of Classification Search
CPC ..... A24F 47/008; A24F 47/002; A24F 40/00; A24F 40/42; A24F 40/49
(Continued)

(56) References Cited

U.S. PATENT DOCUMENTS

2017/0181476 A1* 6/2017 Li ..... A24F 40/42
2018/0000156 A1* 1/2018 Qiu ..... A24F 47/008
(Continued)

FOREIGN PATENT DOCUMENTS

CN 102869403 A 1/2013
CN 204409585 U 6/2015
(Continued)

*Primary Examiner* — Hae Moon Hyeon
(74) *Attorney, Agent, or Firm* — Novick, Kim & Lee, PLLC; Allen Xue

(57) ABSTRACT

An elastic locking mechanism, an atomizer for an electronic cigarette, and an electronic cigarette are disclosed. The elastic locking mechanism includes an upper cover removably arranged on an opening end of a liquid storage assembly, a screw cap sleeved outside the upper cover, an upper engagement component arranged on the screw cap, a lower engagement component arranged on the upper cover, and an elastic element mounted between the screw cap and the upper cover to prevent the upper engagement component and the lower engagement component from engaging each other. When the screw cap is pressed down or pulled up, the elastic element is compressed or stretched so that the upper engagement component engages the lower engagement component, and the upper cover is driven to rotate together with the screw cap by rotating the screw cap.

19 Claims, 12 Drawing Sheets

(51) Int. Cl.

| | |
|---|---|
| ***A24F 25/00*** | (2006.01) |
| ***A24F 47/00*** | (2020.01) |
| ***A24F 40/00*** | (2020.01) |
| ***A24F 40/49*** | (2020.01) |

(58) Field of Classification Search
USPC ..... 131/329, 328
See application file for complete search history.

(56) References Cited

U.S. PATENT DOCUMENTS

| | | | | |
|---|---|---|---|---|
| 2019/0021398 | A1* | 1/2019 | Qiu | A24F 47/00 |
| 2019/0067666 | A1* | 2/2019 | Qiu | A24F 47/008 |
| 2019/0328044 | A1* | 10/2019 | Qiu | A24F 47/008 |
| 2020/0187567 | A1* | 6/2020 | Liu | F16J 15/022 |

FOREIGN PATENT DOCUMENTS

| | | | |
|---|---|---|---|
| CN | 204540816 | U | 8/2015 |
| CN | 204599325 | U | 9/2015 |
| CN | 204861176 | U | 12/2015 |
| CN | 105380299 | A | 3/2016 |
| CN | 105520196 | A | 4/2016 |
| CN | 105725278 | A | 7/2016 |
| CN | 205456059 | U | 8/2016 |
| CN | 205547362 | U | 9/2016 |
| CN | 105996134 | A | 10/2016 |
| CN | 206005951 | U | 3/2017 |
| CN | 206294746 | U | 7/2017 |
| CN | 206603249 | U | 11/2017 |
| WO | 2011146315 | A2 | 11/2011 |
| WO | 2012070107 | A1 | 5/2012 |

* cited by examiner

ELASTIC LOCKING MECHANISM FOR ELECTRONIC CIGARETTE, ATOMIZER, AND ELECTRONIC CIGARETTE

CROSS REFERENCE TO RELATED APPLICATIONS

This application claims all benefits accruing under 35 U.S.C. § 119 from China Patent Application No. 201610031195.5, filed on Jan. 18, 2016 in the China Intellectual Property Office, and from China Patent Application No. 201610197619.5, filed on Mar. 31, 2016 in the China Intellectual Property Office, the content of which is hereby incorporated by reference. This application is a continuation-in-part of international patent application PCT/CN2017/070956, filed on Jan. 12, 2017.

FIELD OF TECHNOLOGY

The present disclosure relates generally to the field of electronic cigarette, and more particularly, to an elastic locking mechanism for an electronic cigarette, an atomizer having the elastic locking mechanism, and an electronic cigarette having the atomizer.

BACKGROUND

At present, electronic cigarettes have become relatively mature substitutes for cigarette smoking in the market. When a heating element in an atomizer is powered by a battery, the heating element can be electrically driven to heat tobacco liquid to produce smoke, therefore users can get a smoking experience.

For a traditional electronic cigarette, it is easy to fill liquid into the liquid storage tube by simply unscrewing the upper cover of the electronic cigarette. In such case, the upper cover of the electronic cigarette is easy to be unscrewed by a child if the child gets and plays with the electronic cigarette. Thus, the child may be exposed to the tobacco liquid or the like stored in the liquid storage tube, which is a hazardous for children.

SUMMARY

In view of the above, in order to cater to the needs of the market, an objective of the present disclosure to provide an elastic locking mechanism for an electronic cigarette, an atomizer having the elastic locking mechanism, and an electronic cigarette having the atomizer, to improve safety and protection for the children.

According to one aspect of the present disclosure, an elastic locking mechanism for an electronic cigarette is provided. The electronic cigarette includes a liquid storage assembly provided with an opening end. The elastic locking mechanism includes an upper cover removably arranged on the opening end of the liquid storage assembly, a screw cap sleeved outside the upper cover, an upper engagement component arranged on the screw cap, a lower engagement component arranged on the upper cover, and an elastic element mounted between the screw cap and the upper cover to prevent the upper engagement component and the lower engagement component from engaging each other. When the screw cap is pressed down or pulled up, the elastic element is compressed or stretched so that the upper engagement component engages the lower engagement component, and the upper cover is driven to rotate together with the screw cap by rotating the screw cap, to open or close the opening end of the liquid storage assembly.

In one embodiment, the upper cover includes an upper cover bottom wall and a connection circumference wall formed on the upper cover bottom wall. The connection circumference wall and the upper cover bottom wall form a containing cavity. The screw cap includes a screw cap top wall, a screw cap outer circumference wall formed on an outer circumference of the screw cap top wall, and a screw cap inner circumference wall formed on a bottom surface of the screw cap top wall, and an annular space is formed between the screw cap outer circumference wall and the screw cap inner circumference wall.

In one embodiment, the upper engagement component is fixedly arranged in the annular space of the screw cap, and the lower engagement component is fixedly arranged in the accommodating cavity of the upper cover. A bottom surface of the upper engagement component is provided with at least one fixing block, and a top surface of the lower engagement component is provided with at least one fixing groove matching the at least one fixing block. Alternatively, the top surface of the lower engagement component is provided with at least one fixing block, and the bottom surface of the upper engagement component is provided with at least one fixing groove matching the at least one fixing block.

In one embodiment, a length of the fixing groove in an arc direction is greater than or equal to a length of the fixing block in an arc direction.

In one embodiment, the upper cover further includes an upper cover circumference edge formed on a top side of the connection circumference wall and extending outward, and a top circumference wall formed on a top surface of the upper cover circumference edge vertically. The upper engagement component is fixedly arranged in the annular space of the screw cap, the lower engagement component is fixedly arranged on the upper cover circumference edge, and the lower engagement component is sleeved outside the upper engagement component. A bottom end of a circumference wall of the upper engagement component is provided with a circumferential edge extending outward, the circumferential edge is provided with at least one fixing block protruding upward, a top end of the lower engagement component is provided with an annular cover top wall, and the cover top wall is provided with at least one projection protruding downward.

In one embodiment, one end of the elastic element is fixedly arranged on the screw cap inner circumference wall, and the other end of the elastic element abuts against a top surface of the upper cover bottom wall at installation. Alternatively, one end of the elastic element is fixedly arranged on the top surface of the upper cover bottom wall, and the other end of the elastic element abuts against the screw cap inner circumference wall at installation.

In one embodiment, the upper cover is provided with at least one first air inlet groove, the screw cap is provided with at least one second air inlet groove, and the at least one first air inlet groove is gradually aligned or staggered with the at least one second air inlet groove when the screw cap is turned with respect to the upper cover.

In one embodiment, an outer circumference surface of the upper cover is provided with a convex column extending into the second air inlet groove, a width of the second air inlet groove in an axial direction is greater than a diameter of the convex column.

In one embodiment, the elastic locking mechanism further includes a ventilation tube and an unlocking component, the upper cover and the lower engagement component are integrated to form the ventilation tube, the screw cap and the upper engagement component are integrated to form the unlocking component, the ventilation tube is provided with a stop protrusion/groove, and the unlocking component is provided with a corresponding stop groove/protrusion.

In one embodiment, the ventilation tube is provided with a stop protrusion, the elastic element is provided with a blocking groove matching the stop protrusion such that the elastic element is sleeved outside the ventilation tube.

In one embodiment, the elastic element is made up of rubber or silicone.

According to another aspect of the present disclosure, an atomizer having any one of the above elastic locking mechanisms is provided.

In one embodiment, the atomizer further includes a smoke guiding assembly, an atomizing assembly and a liquid storage assembly. The atomizing assembly is arranged in an inner cavity of the liquid storage assembly, the elastic locking mechanism is removably arranged on the liquid storage assembly, one end of the elastic locking mechanism is connected to the smoke guiding assembly, and the other end of the elastic locking mechanism is connected to the atomizing assembly.

In one embodiment, the upper cover is integrally connected to a connection tube with an outlet end opposed to the upper cover. The outlet end of the connection tube is connected to the atomizing assembly. The smoke guiding assembly includes a smoke outlet tube and an air inlet tube. The smoke outlet tube extends into the connection tube through the top of the screw cap, the air inlet tube is mounted at the outlet end of the connection tube and sleeved on the smoke outlet tube, the air inlet tube communicates a channel of the smoke outlet tube with an inner cavity of the atomizing assembly, an air guiding gap is formed between an outer circumference wall of the smoke outlet tube and an inner circumference wall of the connection tube, outer circumference surface of the air inlet tube is provided with at least one air guiding groove, and the air guiding groove communicates the air guiding gap with the inner cavity of the atomizing assembly.

In one embodiment, the atomizing assembly includes an atomizer head with a heating element inside, the liquid storage assembly includes a liquid storage tube and a conductive base arranged at the bottom of the liquid storage tube, the atomizer head is arranged inside the liquid storage tube, a liquid storage space is formed between an inner circumference wall of the liquid storage tube and an outer circumference wall of the atomizer head, and the conductive base is electrically connected to the heating element.

In one embodiment, the atomizer further includes an atomizer head, an atomizing tube, a ventilation tube, an unlocking component and an inlet and outlet separation tube. The upper cover and the lower engagement component are integrated to form the ventilation tube, the screw cap and the upper engagement component are integrated to form the unlocking component, a lower end of the ventilation tube is removably connected to the atomizer head, the unlocking component is sleeved outside an upper end of the ventilation tube, the ventilation tube is sleeved outside the inlet and outlet separation tube, one end of the atomizing tube is communicated to the atomizer head, and the other end of the atomizing tube fits the inlet and outlet separation tube tightly.

According to a further aspect of the present disclosure, an electronic cigarette is provided, including a liquid storage assembly with an opening end, and any one of the above atomizers.

In one embodiment, the electronic cigarette further includes a housing and a battery assembly, both the battery assembly and the liquid storage assembly are arranged inside the housing, the liquid storage assembly is provided with a liquid storage cavity, and a part of the atomizer is arranged inside the liquid storage cavity.

In one embodiment, a bottom of the atomizer is provided with a first electrical contact, and the liquid storage assembly is provided with a second electrical contact electrically connected to the first electrical contact.

According to a further aspect of the present disclosure, an elastic locking mechanism for an electronic cigarette is provided, including an upper cover removably arranged on an opening end of a liquid storage assembly, a screw cap sleeved outside the upper cover, an upper engagement component fixedly arranged inside the screw cap, a lower engagement component fixedly arranged inside the upper cover, and an elastic element mounted between the screw cap and the upper cover to prevent the upper engagement component and the lower engagement component from engaging each other. When the screw cap is pressed down or pulled up, the elastic element is compressed or stretched so that the upper engagement component engages the lower engagement component, and the upper cover is driven to rotate together with the screw cap by rotating the screw cap.

In one embodiment, the upper cover includes an upper cover bottom wall and a connection circumference wall formed on the upper cover bottom wall, the connection circumference wall and the upper cover bottom wall form a containing cavity. The screw cap includes a screw cap top wall, a screw cap outer circumference wall formed on an outer circumference of the screw cap top wall, and a screw cap inner circumference wall formed on a bottom surface of the screw cap top wall, and an annular space is formed between the screw cap outer circumference wall and the screw cap inner circumference wall.

In one embodiment, the upper engagement component is fixedly arranged in the annular space of the screw cap, and the lower engagement component is fixedly arranged in the accommodating cavity of the upper cover. A bottom surface of the upper engagement component is provided with at least one fixing block, and a top surface of the lower engagement component is provided with at least one fixing groove matching the at least one fixing block. Alternatively, the top surface of the lower engagement component is provided with at least one fixing block, and the bottom surface of the upper engagement component is provided with at least one fixing groove matching the at least one fixing block.

In one embodiment, a length of the fixing groove in an arc direction is greater than or equal to a length of the fixing block in an arc direction.

In one embodiment, the upper cover further includes an upper cover circumference edge formed on a top side of the connection circumference wall and extending outward, and a top circumference wall formed on a top surface of the upper cover circumference edge vertically.

In one embodiment, the upper cover further includes an upper cover circumference edge formed on a top side of the connection circumference wall and extending outward, and a top circumference wall formed on a top surface of the upper cover circumference edge vertically. The upper engagement component is fixedly arranged in the annular space of the screw cap, the lower engagement component is fixedly arranged on the upper cover circumference edge, and the lower engagement component is sleeved outside the upper engagement component. A bottom end of a circumference wall of the upper engagement component is provided with a circumferential edge extending outward, the circumferential edge is provided with at least one fixing block protruding upward, a top end of the lower engagement component is provided with an annular cover top wall, and the cover top wall is provided with at least one projection protruding downward.

In one embodiment, one end of the elastic element is fixedly arranged on the screw cap inner circumference wall, and the other end of the elastic element abuts against a bottom surface of the containing cavity of the upper cover at installation. Alternatively, one end of the elastic element is fixedly arranged on the bottom surface of the containing cavity of the upper cover, and the other end of the elastic element abuts against a bottom surface of the screw cap inner circumference wall at installation.

In one embodiment, the top circumference wall is provided with at least one first air inlet groove in a circumferential direction, an inner side of the outer circumference wall fits an outer side of the top circumference wall, the screw cap is provided with at least one second air inlet groove in a circumferential direction, and the at least one first air inlet groove is gradually aligned or staggered with the at least one second air inlet groove when the screw cap is rotated.

According to a further aspect of the present disclosure, an atomizer having the above elastic locking mechanism is provided.

The atomizer includes a smoke guiding assembly, an atomizing assembly, a liquid storage assembly and the above elastic locking mechanism. One end of the elastic locking mechanism is mounted on the top of the atomizing assembly and removably arranged on the liquid storage assembly, the smoke guiding assembly is mounted on an end of the elastic locking mechanism opposed to the atomizing assembly and is communicated to an inner cavity of the atomizing assembly. The liquid storage assembly including a liquid storage tube, an atomizer head is housed inside the liquid storage tube, and a liquid storage space is formed between an inner circumference wall of the liquid storage tube and an outer circumference wall of the atomizer head.

In one embodiment, the upper cover further includes a connection tube integrally connected to a bottom surface of the upper cover bottom wall. The smoke guiding assembly includes a smoke outlet tube and an air inlet tube. An end of the smoke outlet tube extends into the connection tube, the air inlet tube is mounted on an outlet end of the connection tube and sleeved on the end of the smoke outlet tube, an air guiding gap is formed between an outer circumference wall of the smoke outlet tube and an inner circumference wall of the connection tube, and an outer circumference surface of the air inlet tube is provided with at least one air guiding groove communicating the air guiding gap to an inner cavity of the atomizing assembly.

According to a further aspect of the present disclosure, an electronic cigarette having said the above atomizer is provided, in which a battery assembly is mounted at the bottom of the atomizer.

The electronic cigarette includes an atomizing assembly. The atomizing assembly includes an air inlet tube, an unlocking component and a blocking component. The unlocking component is sleeved outside an upper end of the air inlet tube, the blocking component is sleeved outside the air inlet tube and arranged between the air inlet tube and the unlocking component, the air inlet tube is provided with a stop protrusion/groove, the unlocking component is provided with a stop groove/protrusion, the blocking component is an elastic component, the blocking component is provided with a blocking groove matching the stop protrusion, and when the unlocking component is pressed so that the stop groove engages the stop protrusion, the electronic cigarette is in an unlocked state.

In one embodiment, the electronic cigarette further includes a battery assembly and a liquid storage assembly, the battery assembly and the liquid storage assembly are arranged inside a housing, the liquid storage assembly is provided with a liquid storage cavity, and a part of the atomizing assembly is arranged inside the liquid storage cavity.

In one embodiment, an outer periphery of said the air inlet tube is provided with connection thread, the liquid storage assembly further includes a thread ring matching the connection thread, and the air inlet tube is removably connected to the liquid storage assembly by cooperation between the connection thread and the thread ring.

In one embodiment, the thread ring is arranged on an upper end of the liquid storage cavity.

In one embodiment, the atomizing assembly includes an atomizer head removably connected to a lower end of the air inlet tube, a peripheral portion of the air inlet tube close to an upper end of the air inlet tube extends outward to form a convex edge, a connection portion is formed between a lower end of the air inlet tube and the convex edge, and the connection thread is arranged on a outer circumference of the connection portion.

In one embodiment, the atomizing assembly further includes an atomizing tube and an air inlet and outlet separation tube, the air inlet tube is sleeved outside the air inlet and outlet separation tube, one end of the atomizing tube is fluid communication with the atomizer head and the other end is closely fit the air inlet and outlet separation tube.

In one embodiment, the bottom of the atomizer head is provided with a first electrical contact and the liquid storage assembly is provided with a second electrical contact electrically connected to the first electrical contact.

In one embodiment, the battery assembly includes a battery, a circuit board assembly support mounted inside the housing, a circuit board assembly mounted on the circuit board assembly support, a battery gasket mounted at an end of the housing, and a battery bottom cover connected to the housing by an interference fit.

In one embodiment, the blocking component is made of rubber or silicone.

In one embodiment, the electronic cigarette further includes a removable cigarette holder, an end of the air inlet and outlet separation tube far away from the atomizing tube is provided with a mounting hole, one end of the cigarette holder is inserted into the mounting hole.

For the elastic locking mechanism according to the present disclosure, the screw cap should be pressed down or pulled up by resisting a certain amount of elastic force firstly, and then the upper cover may be rotated together with the screw cap by the rotation of the screw cap when the screw cap engages the upper cover. Compared with the prior art, the elastic locking mechanism according to the present disclosure is favorable to protect the rotation operation of the upper cover. Therefore, the elastic locking mechanism, the atomizer having the elastic locking mechanism and the electronic cigarette having the atomizer have a children lock function, which can prevent the upper cover from being removed by a child easily, and prevent the children from touching and eating the tobacco liquid.

Preferred embodiments of the present invention and their advantageous effects will be detailed by reference to the following description.

DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment.

DESCRIPTION OF REFERENCE NUMERALS

1: Elastic Locking Mechanism;
2: Smoke guiding assembly;
3: Atomizing assembly;
4: Liquid storage assembly;
5: Battery assembly;
10: Upper cover;
11: Upper cover bottom wall;
12: Connection circumference wall;
13: Upper cover circumference edge;
14: Top circumference wall;
15: Connection tube;
20: Screw cap;
21: Screw cap top wall;
22: Screw cap outer circumference wall;
23: Center hole;
24: Screw cap inner circumference wall;
30, 60: Upper engagement component;
40, 70: Lower engagement component;
31, 61: Fixing block;
41, 71: Fixing groove;
50: Elastic element;
141: First Air inlet groove;
201: Cigarette holder;
202: Smoke outlet tube;
203: Air inlet tube;
221: Second air inlet groove;
231: Air guiding groove;
301: Atomizer head;
401: Liquid storage tube;
812-3: Connection portion;
81: Battery bottom cover;
82: Battery gasket;
83: Battery assembly;
84: Circuit board assembly;
85: Housing;
86: Circuit board assembly support;
87: Liquid storage assembly;
87-1: Liquid storage cavity;
87-2: Second electrical contact;
88: Button;
89: Thread ring;
810: Atomizer head;
810-1: First electrical contact;
811: Atomizing tube;
812: Ventilation tube;
812-1: Stop Protrusion;
813: Unlocking component;
813-1: Stop Groove;
814: Air inlet and outlet separation tube;
814-1: Mounting hole;
815: Cigarette holder;
816: Main Body;
817: Atomizer;
818: Elastic element;
818-1: Blocking Groove: 818-1;
819: Battery: 819
812-2: Convex edge; and
820: Window.

DETAILED DESCRIPTION

In the following description of embodiments, reference is made to the accompanying drawings which form a part hereof, and in which it is shown by way of illustration specific embodiments of the disclosure that can be practiced. It is to be understood that other embodiments can be used and structural changes can be made without departing from the scope of the disclosed embodiments.

Embodiment 1

Figure 1:
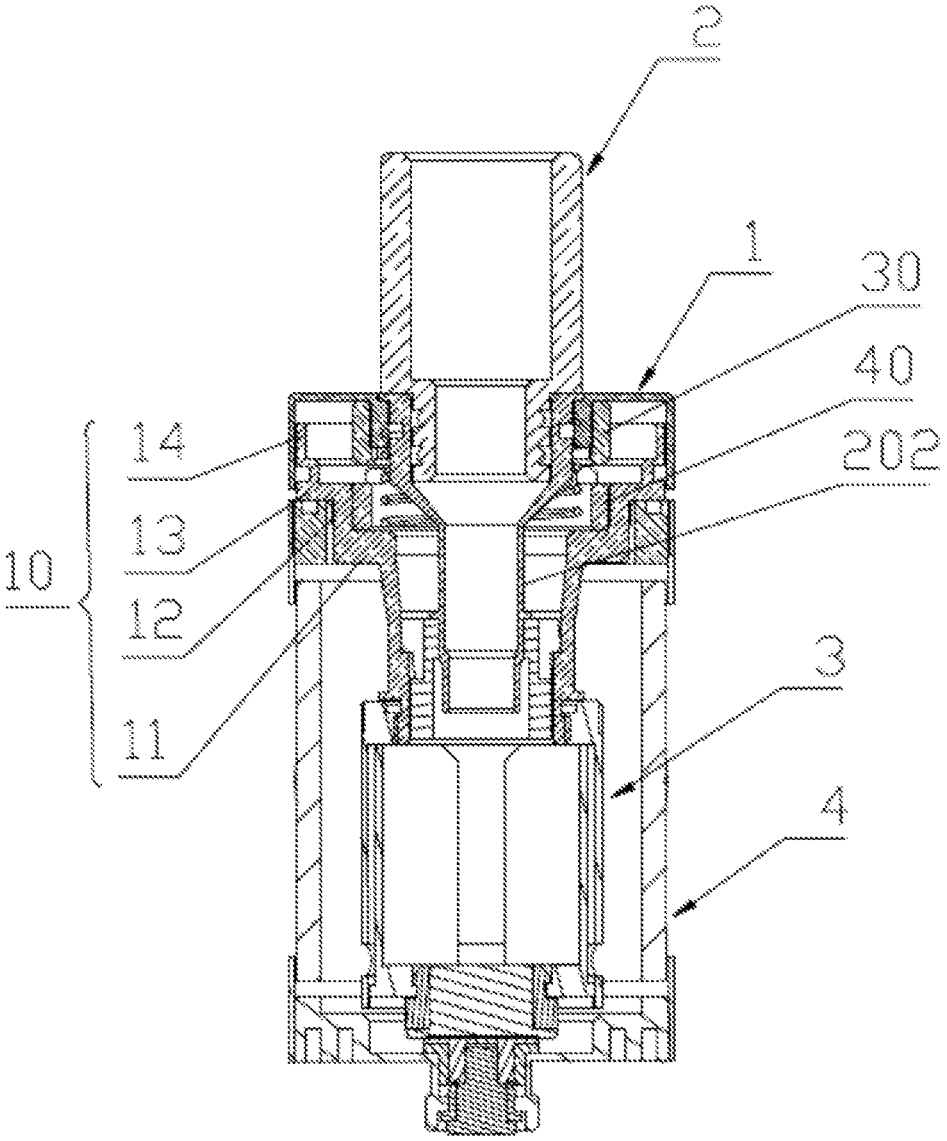
FIG. 1 is a cross-sectional view of an overall structure of an atomizer according to a first embodiment of the present disclosure.

Referring to FIG. 1, an atomizer is provided in the first embodiment of the present disclosure, including an elastic locking mechanism 1 for an electronic cigarette, a smoke guiding assembly 2, an atomizing assembly 3 and a liquid storage assembly 4. One end of the elastic locking mechanism 1 is removably arranged on an opening end of the liquid storage assembly 4, and the other end of the elastic locking mechanism 1 is connected to the smoke guiding assembly 2. The atomizing assembly 3 is arranged inside an inner cavity of the liquid storage assembly 4 and connected to one end of the elastic locking mechanism 1 opposed to the smoke guiding assembly 2.

Figure 2:
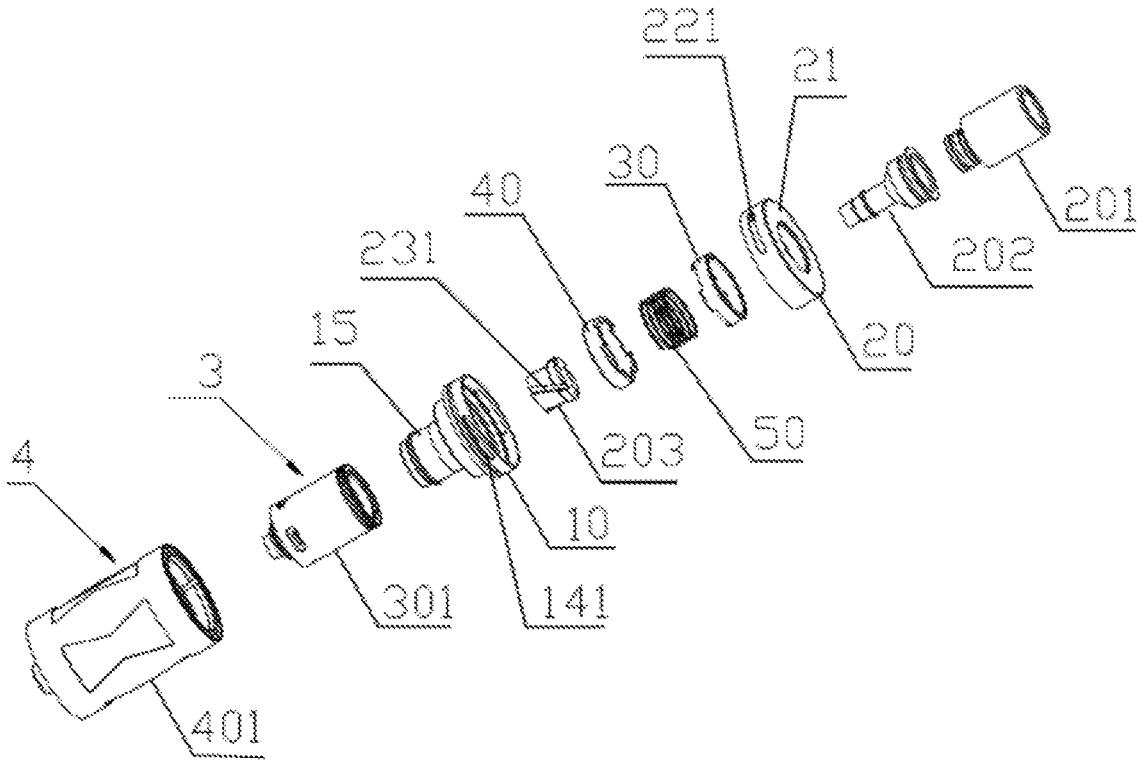
FIG. 2 is an exploded view of the atomizer according to the first embodiment of the present disclosure.
Figure 3:
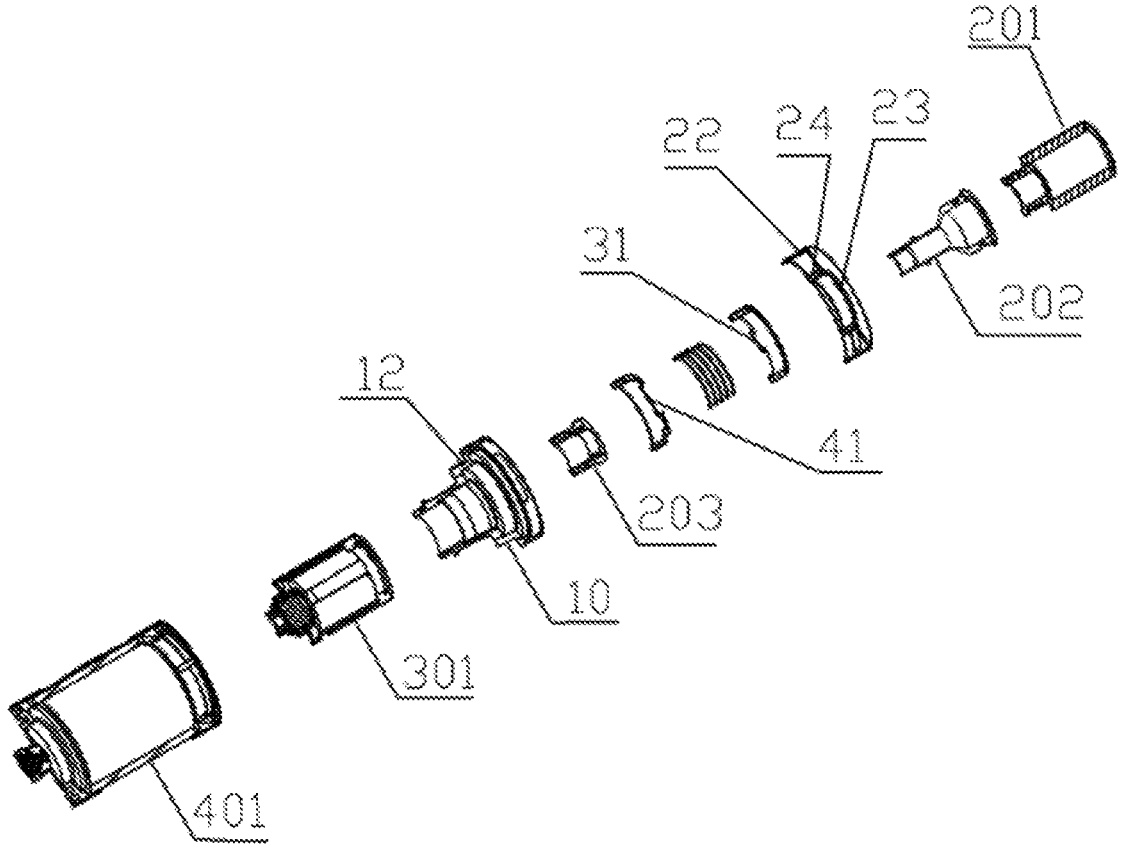
FIG. 3 is an isometric view of the atomizer in FIG. 2.
Figure 4:
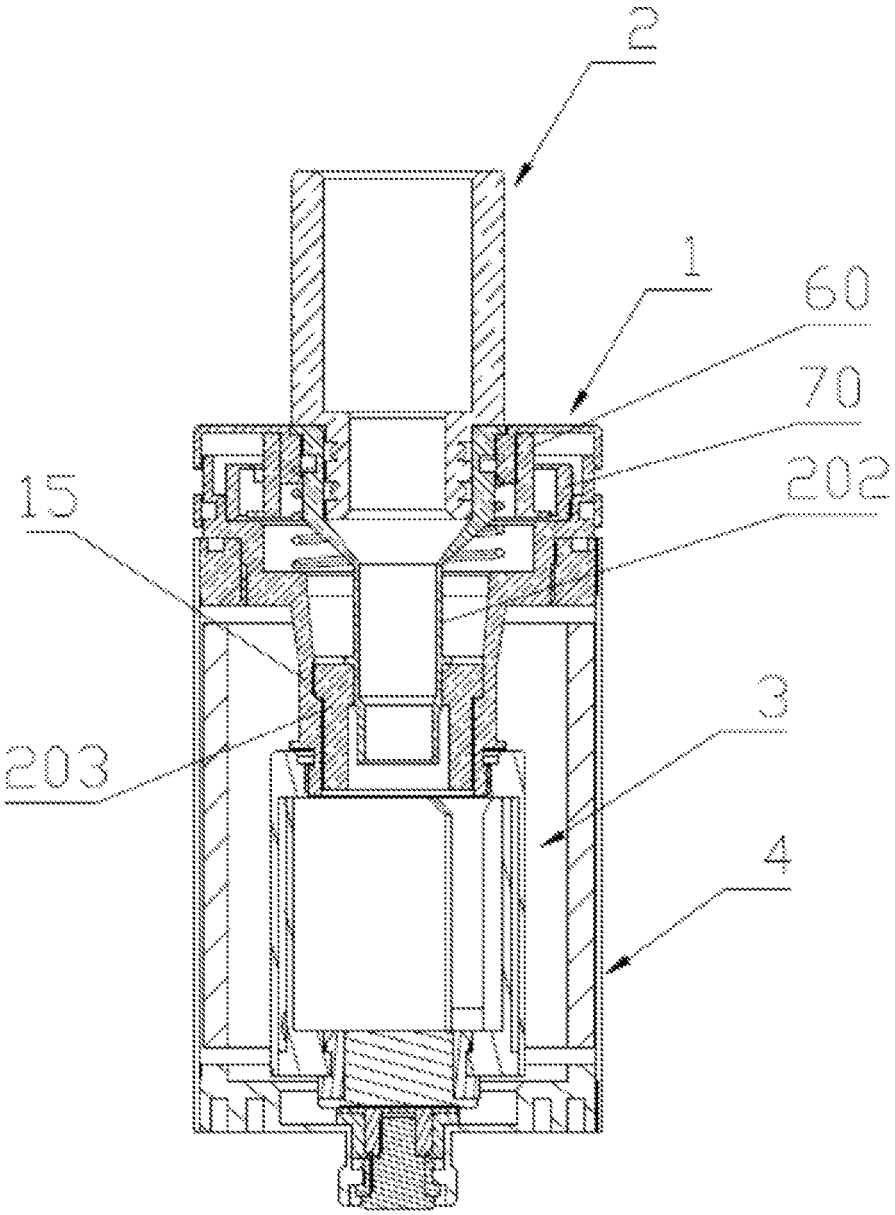
FIG. 4 is cross-sectional view of an overall structure of an atomizer according to a second embodiment of the present disclosure.
Figure 5:
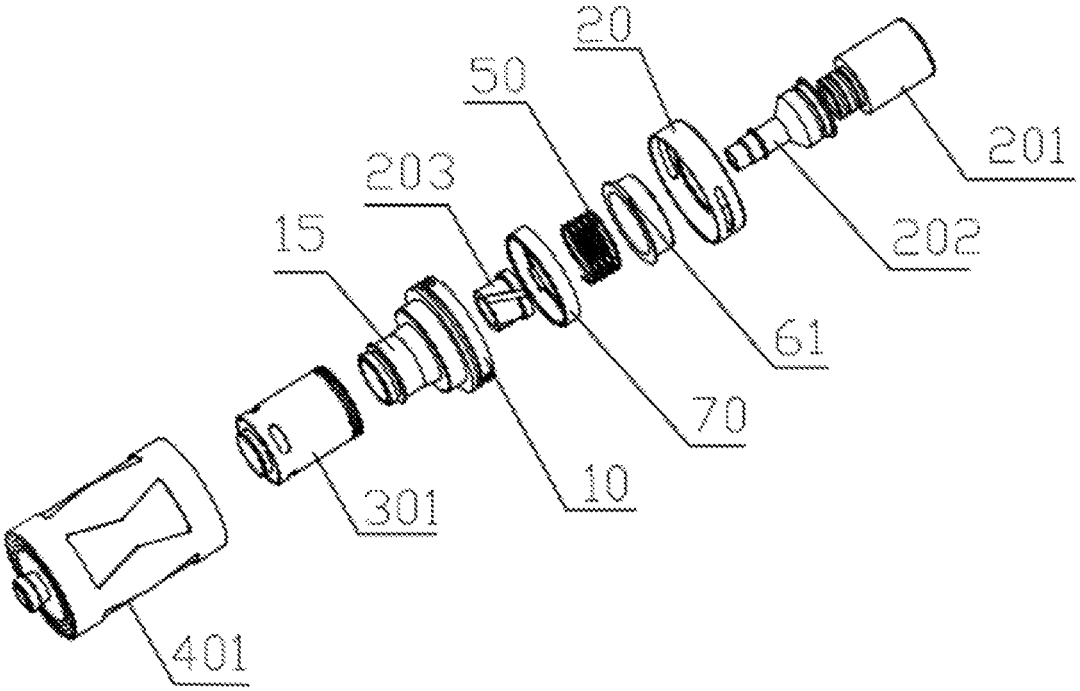
FIG. 5 is an exploded view of the atomizer according to the second embodiment of the present disclosure.
Figure 6:
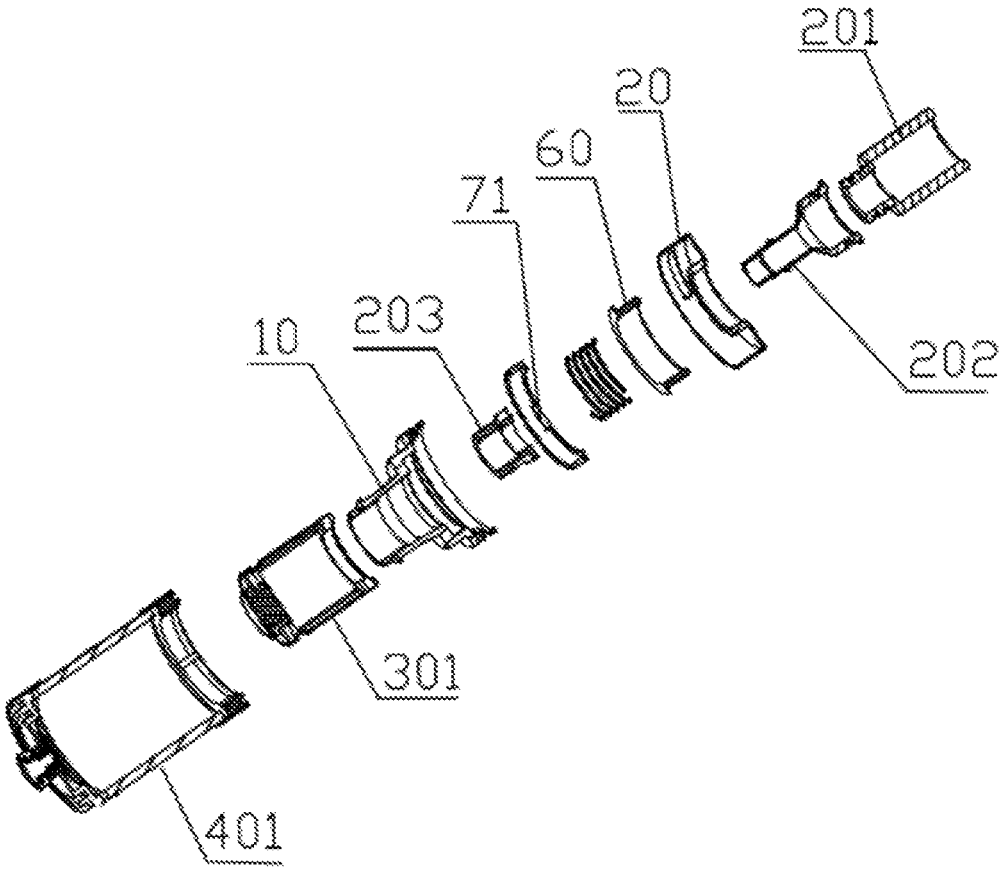
FIG. 6 is an isometric view of the atomizer in FIG. 5.

Referring to FIGS. 2 and 3, when adding liquid, the elastic locking mechanism 1 should be pressed down so that two ends of the elastic locking mechanism 1 engage each other, and then elastic locking mechanism 1 is able to be rotated to disengage from the liquid storage assembly 4 to expose the opening end of the liquid storage assembly 4. Since children's thoughts are relatively simple, and it is difficult for them to think of removing the elastic locking mechanism 1 by a series of actions of pressing down and rotating the elastic locking mechanism 1, thus, it can prevent the children from being exposed to the tobacco liquid. In addition, the elastic locking mechanism 1 has a function of adjusting the air inflow of the atomizing assembly 3.

The elastic locking mechanism 1 includes an upper cover 10, a screw cap 20, an upper engagement component 30, a lower engagement component 40 and an elastic element 50. The upper cover 10 is removably arranged on the opening end of the liquid storage assembly 4, the screw cap 20 is sleeved outside the upper cover 10, the upper engagement component 30 is arranged inside the screw cap 20, the lower engagement component 40 is arranged inside the upper cover 10, and the elastic element 50 is arranged between the upper cover 10 and the screw cap 20 to prevent the upper engagement component 30 and the lower engagement component 40 from engaging each other. When the screw cap 20 is pressed down, the elastic element 50 is compressed so that the upper engagement component 30 engages the lower engagement component 40, and the upper cover 10 can be driven by the screw cap 20 to rotate.

The upper cover 10 includes an upper cover bottom wall 11, a connection circumference wall 12 formed on the upper cover bottom wall 11, an upper cover circumference edge 13 formed on a top side of the connection circumference wall 12 and extending outward, and a top circumference wall 14 formed on a top surface of the upper cover circumferential edge 13 vertically. The connection circumference wall 12 and the upper cover bottom wall 11 form a containing cavity. The top circumference wall 14 is provided with at least one first air inlet groove 141 in a circumferential direction. Further, the upper cover 10 includes a connection tube 15 integrally connected to a bottom surface of the upper cover bottom wall 11, and the connection tube 15 is in fluid communication with the containing cavity formed by the connection circumference wall 12 and the top cover bottom 11.

The screw cap 20 is sleeved on the upper cover 10, including a screw cap top wall 21 and a screw cap outer circumference wall 22 vertically formed on a periphery of the screw cap top wall 21. The center of the screw cap top wall 21 is provided with a center hole 23. The screw cap 20 further includes a screw cap inner circumference wall 24 arranged around the center hole 23 and perpendicularly to the screw cap top wall 21. Thus, an annular space is formed between the screw cap outer circumference wall 22 and the screw cap inner circumference wall 24. The screw cap outer circumference wall 22 is provided with at least one second air inlet groove 221 in the circumferential direction.

The upper engagement component 30 has a shape of a circular ring. The upper engagement component 30 is fixedly arranged inside the annular space of the screw cap 20 by an interference fit with the outer side of the screw cap inner circumference wall 24. A bottom surface of the upper engagement component 30 is provided with at least one fixing block 31.

The lower engagement component 40 has a shape of a circular ring matching the upper engagement component 30. The lower engagement component 40 is fixedly arranged inside the containing cavity of the upper cover 10 by an interference fit with the inner side of the connection circumference wall 12. A top surface of the lower engagement component 40 is provided with at least one fixing groove 41 used for cooperating with the fixing block 31 of the upper engagement component 30. The length of the fixing groove 41 in the arc direction is greater than or equal to the length of the fixing block 31 in the arc direction. When the fixing block 31 of the upper engagement component 30 is inserted into the fixing groove 41 and rotated a predetermined angle with regards to the fixing groove 41, the fixing block 31 abuts against the side wall of the fixing groove 41. When continue to turn the upper engagement component 30, the lower engagement component 40 is driven to rotate by the upper engagement component 30.

It will be understood that in other embodiments, the at least one fixing block 31 is arranged on the top surface of the lower engagement component 40, and the at least one fixing groove 41 is arranged on the bottom surface of the upper engagement component 30 accordingly.

It will be understood that the interference fit may be replaced by a threaded connection.

The elastic element 50 has compressive elasticity. One end of the elastic element 50 is fixedly arranged on the screw cap inner circumference wall 24, and the other end the elastic element 50 abuts against a bottom surface of the containing cavity of the upper cover 10 (i.e., a top surface of the upper cover bottom wall 11) at installation.

It will be understood that in other embodiments, one end of the elastic element 50 is fixedly arranged on a bottom surface of the containing cavity of the upper cover 10 (i.e., a top surface of the upper cover bottom wall 11), and the other end of the elastic element 50 abuts against a bottom surface of the screw cap inner circumference wall 24.

After the elastic locking mechanism 1 has been assembled, the inner side of the screw cap outer circumference wall 22 fits the outer side of the top circumference wall 14, the upper engagement component 30 is arranged inside the annular space of the screw cap 20, the lower engagement component 40 is arranged inside the containing cavity of the upper cover 10, and the fixing groove 41 of the lower engagement component 40 faces the fixing block 31 of the upper engagement component 30. The elastic element 50 is mounted between the upper cover 10 and the screw cap 20. One end of the elastic element 50 is fastened on the screw cap inner circumference wall 24 and the other end of the elastic element 50 abuts against the top surface of the upper cover bottom wall 11 at installation. When the screw cap 20 is pressed down, the fixing block 31 of the upper engagement component 30 is inserted into the fixing groove 41 of the lower engagement component 40. In this case, when the screw cap 20 is rotated, the fixing block 31 rotates a predetermined angle with regards to the fixing groove 41 to abut against the side wall of the fixing groove 41, and when continue to turn the screw cap 20, the upper cover 10 is driven to rotate by the screw cap 20, so the elastic locking mechanism 1 may be removed from the liquid storage assembly 4.

In addition, the outer circumference surface of the top circumference wall 14 of the upper cover 10 is provided with a convex column (not shown). During assembling, the convex column is inserted into the second air inlet groove 221 of the screw cap outer circumference wall 22, to prevent the screw cap 20 from being disengaged from the upper cover 10 in the axial direction. In addition, the width of the second air inlet groove 221 in the axial direction is greater than the diameter of the convex edge, so that the screw cap 20 can be pressed down by a predetermined distance with regards to the upper cover 10, i. e., there is a movement space for the engagement and disengagement of the upper engagement component 30 and the lower engagement component 40.

Smoke guiding assembly 2 includes a cigarette holder 201, a smoke outlet tube 202 and an air inlet tube 203. One end of the cigarette holder 201 is a suction end and the other end of the cigarette holder 201 is a screw joint. The smoke outlet tube 202 has a shape of a trumpet. One end of the smoke outlet tube 202 that is an opening of the trumpet is connected to the screw joint by a threaded connection, and an outer circumference edge is formed on the outer circumference of this end. The other end of the smoke outlet tube 202 is inserted into the connection tube 15 of the upper cover 10. The air inlet tube 203 is fixedly arranged inside an outlet end of the connection tube 15 to communicate the smoke outlet tube 202 and the atomizing assembly 3, so that the smoke in the inner cavity of the atomizing assembly 3 flows towards the smoke outlet tube 202 and then the cigarette holder 201.

The atomizing assembly 3 includes an atomizer head 301 with an inner cavity. One end of the atomizer head 301 is connected to the outlet end of the connection tube 15 of the upper cover 10 to communicate the inner cavity of the atomizer head 301 to the smoke outlet tube 202 through the air inlet tube 203. The other end of the atomizer head 301 is provided with a heating element.

The liquid storage assembly 4 includes a liquid storage tube 401 and a conductive base arranged at the bottom of the liquid storage tube 401. The atomizer head 301 is arranged inside the liquid storage tube 401. A liquid storage space for containing liquid is formed between the inner circumference wall of the liquid storage tube 401 and the outer circumference wall of the atomizer head 301. The conductive base is electrically connected to the heating element located at the other end of the atomizer head 301.

After the atomizer has been assembled, the outlet end of the connection tube 15 is connected to the top of the inner cavity of the atomizer head 301 (i.e., an end of the atomizer head 301 opposed to the heating element) by a threaded connection. The smoke guiding assembly 2 is mounted on the elastic locking mechanism 1. One end of the smoke outlet tube 202 is inserted into the center hole 23 of the screw cap top wall 21, and the outer circumference edge of the smoke outlet tube 202 abuts against the end face of the screw cap top wall 21. The bottom end of the smoke outlet tube 202 (an end opposed to the outer circumference edge) extends into the connection tube 15 and is close to the outlet end of the connection tube 15. An air guiding gap is formed between the outer circumference wall of the smoke outlet tube 202 and the inner circumference wall of the connection tube 15. The air inlet tube 203 is sleeved on the bottom end of the smoke outlet tube 202, and the outer circumference surface of the air inlet tube 203 abuts against the inner circumference surface of the connection tube 15. In this way, the air inlet tube 203 communicates the inner cavity of the atomizer head 301 and the channel of the smoke outlet tube 202. Further, the outer circumference surface of the air inlet tube 203 is provided with at least one air guiding groove 231 communicating both ends of the air inlet tube 203 to communicate the air guiding gap to the inner cavity of the atomizing assembly 3. In this embodiment, the air guiding groove 231 is an inclined groove arranged on the outer circumference surface of the air inlet tube 203 in an axial direction. In this way, the air guiding gap communicates with the air guiding groove 231 to form an air guiding passage, and the external air may flow into the air guiding gap through the second air inlet groove 221 of the screw cap outer circumference wall 22 and the first air inlet groove 141 of the top circumference wall 14, and into the atomizing assembly 3 through the air guiding groove 231.

By rotating the screw cap 20 with regards to the upper cover 10, the first air inlet groove 141 is gradually aligned or staggered with the second air inlet groove 221, thus, the size of the air inlet through hole formed by the first air inlet groove 141 and the second air inlet groove 221 can be adjusted. In this way, the volume of the external air flowing into air guiding passage can be adjusted to achieve the adjustment of the air inlet of the atomizing assembly 3.

Embodiment 2

The configuration of the atomizer in the embodiment 2 is substantially the same as that in the embodiment 1, but the difference is that the configuration and the arrangement of the upper engagement component 60 and the lower engagement component 70 in the embodiment 2 is different from the configuration and the arrangement of the upper engagement component 30 and the lower engagement component 40 in the embodiment 1. In the embodiment 2, the upper engagement component 60 has a shape of a circular ring. The upper engagement component 60 is fixedly arranged inside the annular space of the screw cap 20 by an interference fit with the outer side of the screw cap inner circumference wall 24. A circumference edge extends outward from the bottom of the upper engagement component 60, and is provided with at least one fixing block 61 protruding upward.

The lower engagement component 70 has a shape of a circular ring, the inner diameter of the lower engagement component 70 is greater than the outer diameter of the upper engagement component 60, and the lower engagement component 70 is sleeved on the upper engagement component 60. The lower engagement component 70 is fixedly arranged on the upper cover circumference edge 13 of the upper cover 10 by an interference fit with the inner side of the top circumference wall 14. An annular cover top wall is arranged on the top of the lower engagement component 70, the cover top wall is provided with at least one projection 71 protruding downward, and the projection 71 can cooperate with the fixing block 61 of the upper engagement component 60. When the fixing block 61 is pulled upward to the same horizontal plane as the projection 71, the upper end of the fixing block 61 abuts against the cover top wall of the lower engagement component 70 to prevent the upper engagement component 60 from further moving upward. The upper engagement component 60 is rotated to a predetermined angle so that the fixing block 61 abuts against the side wall of the projection 71. Continue to rotate the upper engagement component 60, the lower engagement component 70 is driven to rotate by the upper engagement component 60. One end of the elastic element 50 is fastened on the screw cap inner circumference wall 24, and the other end of the elastic element 50 abuts against the bottom surface of the containing cavity of the upper cover 10 (i.e., the top surface of the upper cover bottom wall 11) at installation.

It will be understood that in other embodiments, one end of the elastic element 50 is fixedly arranged on the bottom surface of the containing cavity of the upper cover 10 (i.e., the top surface of the upper cover bottom wall 11), and the other end of the elastic element 50 abuts against the bottom surface of the screw cap inner circumference wall 24 at installation.

It will be understood that the interference fit may be replaced by a threaded connection.

In the embodiment 2, after the elastic locking mechanism 1 has been assembled, the inner side of the screw cap outer circumference wall 22 fits the outer side of the top circumference wall 14, the upper engagement component 60 is fixedly arranged inside the annular space of the screw cap 20, the lower engagement component 70 is fixedly arranged on the upper cover circumference edge 13 of the upper cover 10, the projection 71 on the top end of the lower engagement component 70 is arranged above the fixing block 61 of the upper engagement component 60, and the position of the projection 71 corresponds to the position of the fixing block 61. One end of the elastic element 50 is fastened on the screw cap inner circumference wall 24, and the other end of the elastic element 50 abuts against the top surface of the upper cover bottom wall 11. When the screw cap 20 is pulled upward, the elastic element 50 is stretched, the fixing block 61 of the upper engagement component 60 moves up to the same horizontal plane as the projection 71. Then the screw cap 20 is rotated, the fixing block 61 rotates a predetermined distance with regards to the projection 71 and abuts against the side wall of the projection 71, to drive the upper cover 10 to rotate with the screw cap 20.

The principle of adjusting the air of the atomizer applied in the elastic locking mechanism 1 in the embodiment 2 is the same as that in the embodiment 1, which is not described here.

Embodiment 3

Figure 7:
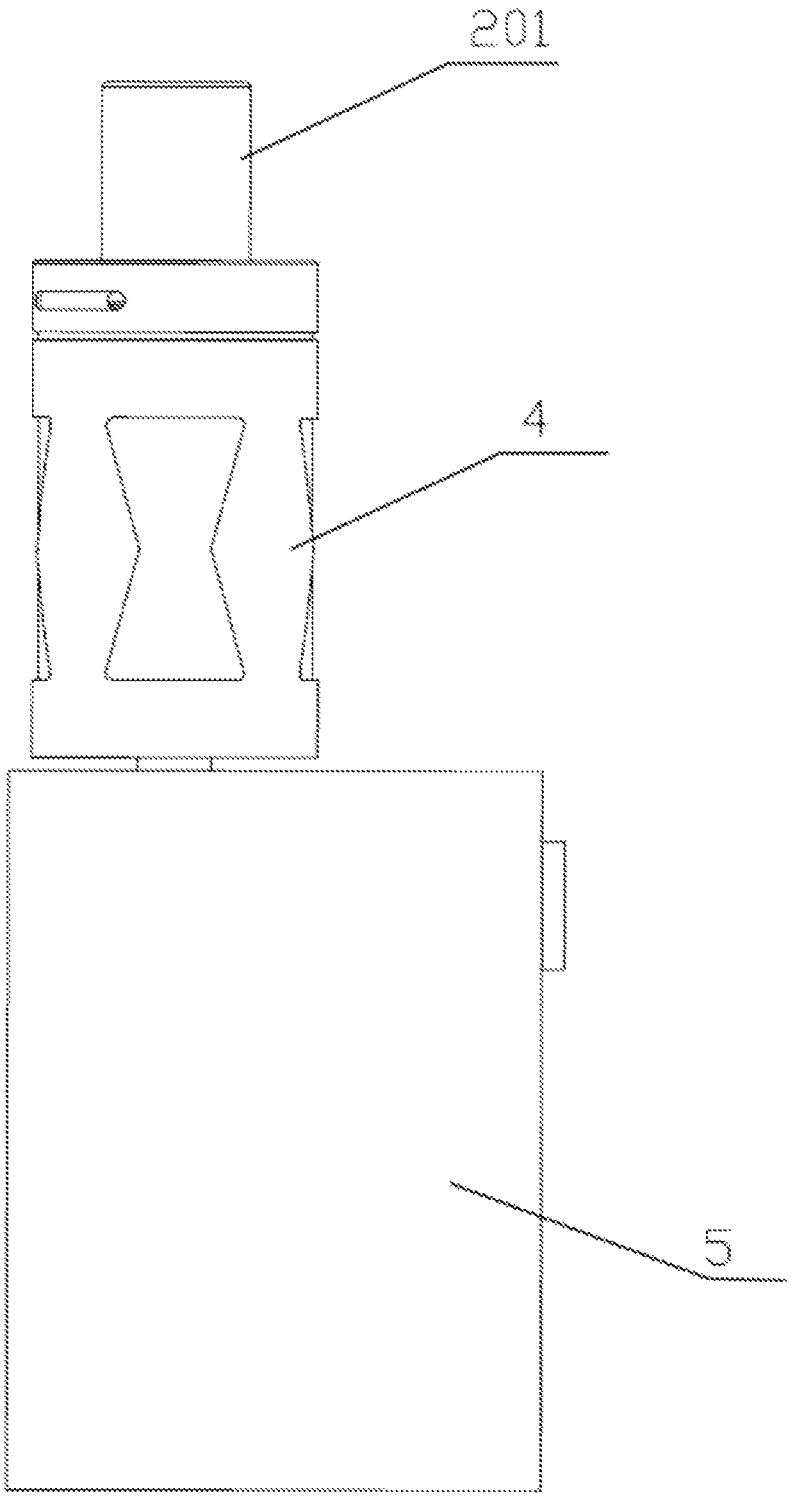
FIG. 7 is a perspective view of an electronic cigarette having the atomizer in FIG. 1 or FIG. 4
Figure 8:
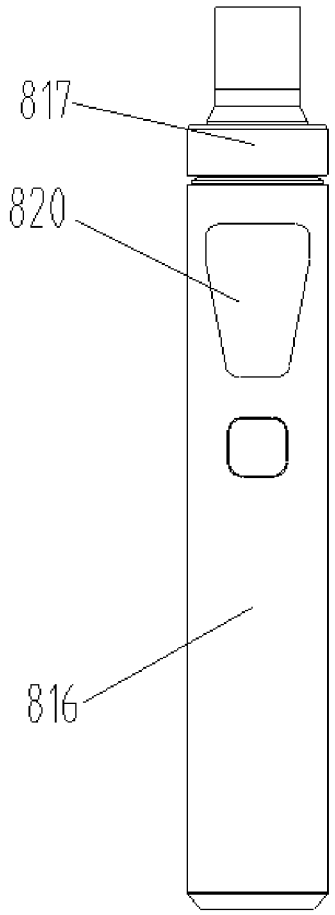
FIG. 8 is a front view of an electronic cigarette according to a fourth embodiment of the present disclosure.
Figure 9:
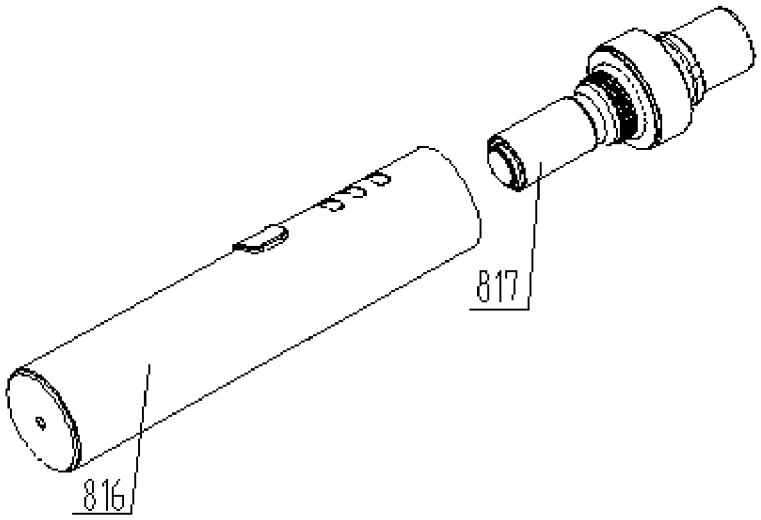
FIG. 9 is a schematic diagram illustrating the electronic cigarette of FIG. 8 in which the atomizer is separated from the main body.
Figure 10:
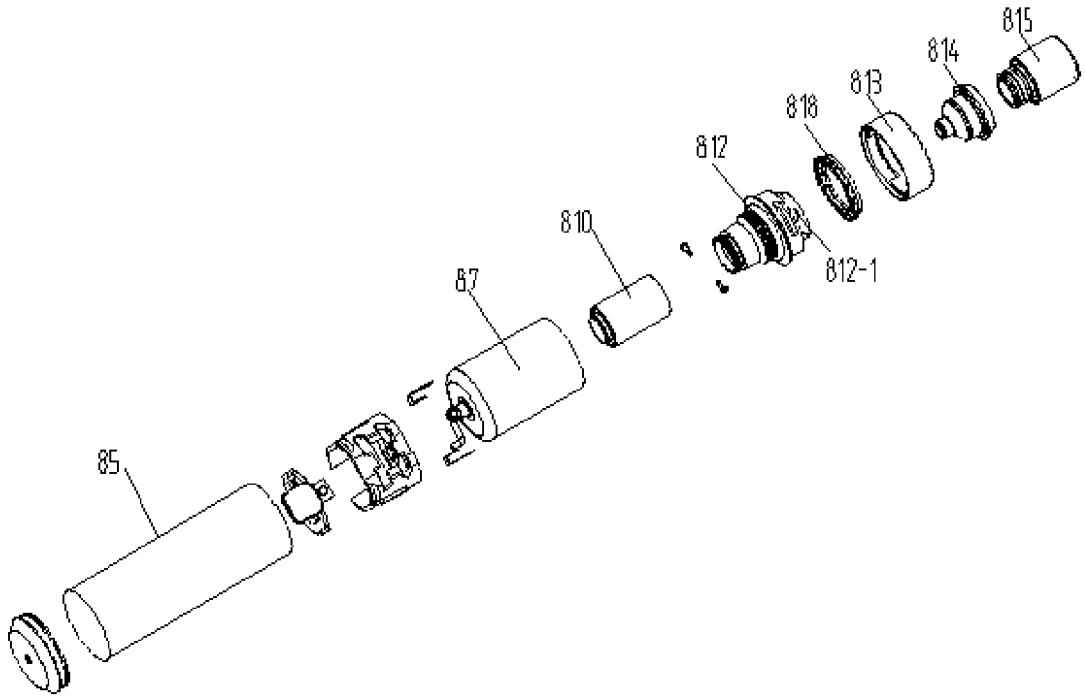
FIG. 10 is an exploded view of the electronic cigarette in FIG. 8.
Figure 11:
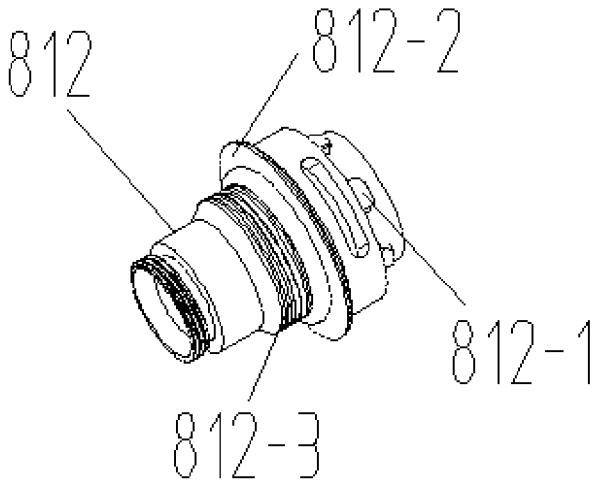
FIG. 11 is a schematic diagram illustrating an air inlet tube of the electronic cigarette in FIG. 10.
Figure 12:
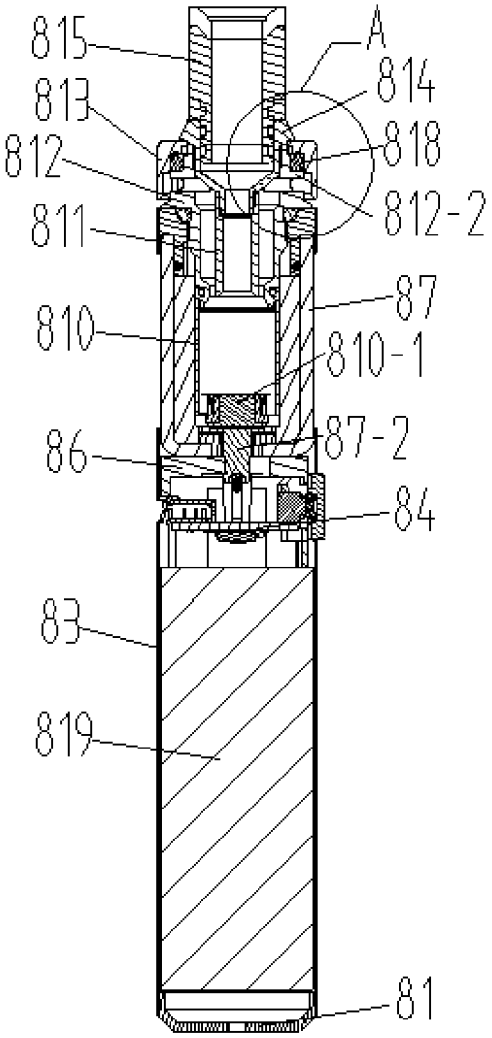
FIG. 12 is a sectional view of the electronic cigarette in FIG. 8 when it is in a locked state.
Figure 13:
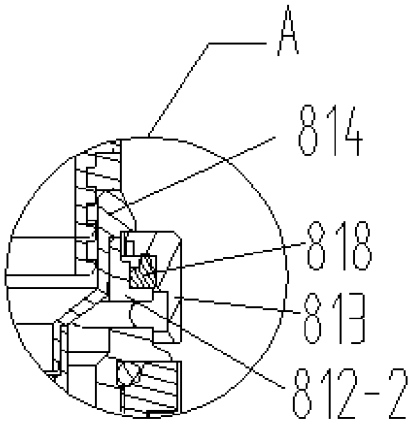
FIG. 13 is an enlarged view of the section A of the electronic cigarette in FIG. 12.
Figure 14:
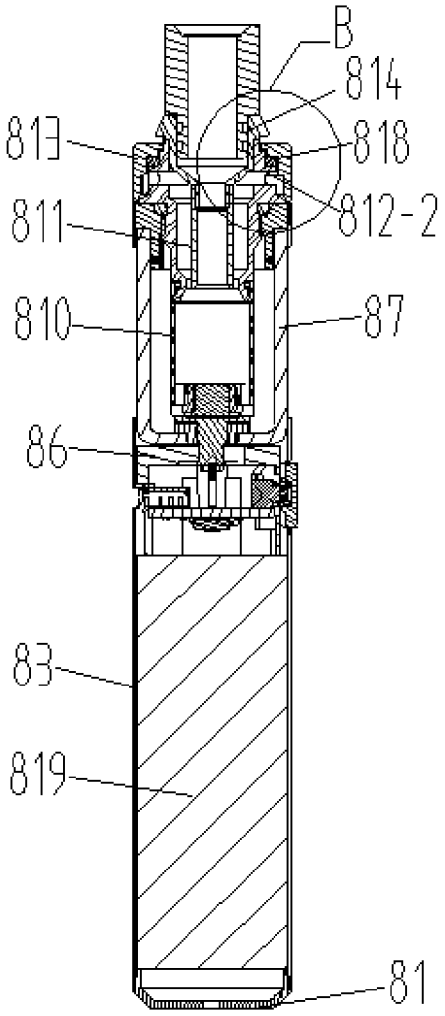
FIG. 14 is a cross-sectional view of the electronic cigarette in FIG. 8 when it is in an unlocked state by pressing.
Figure 15:
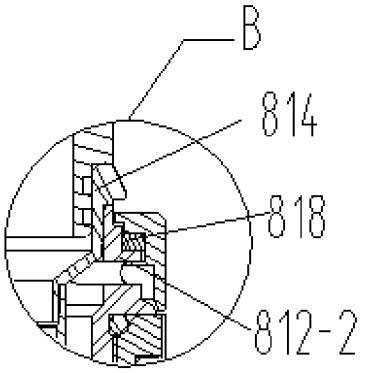
FIG. 15 is an enlarged view of the section B of the electronic cigarette in FIG. 14.
Figure 16:
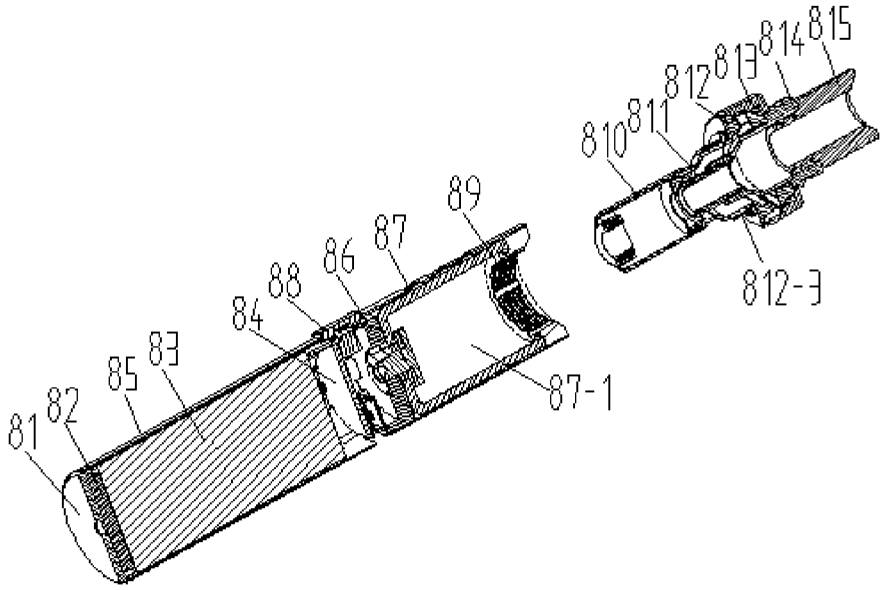
FIG. 16 is a cross-sectional view of the exploded view of the electronic cigarette in FIG. 9.
Figure 17:
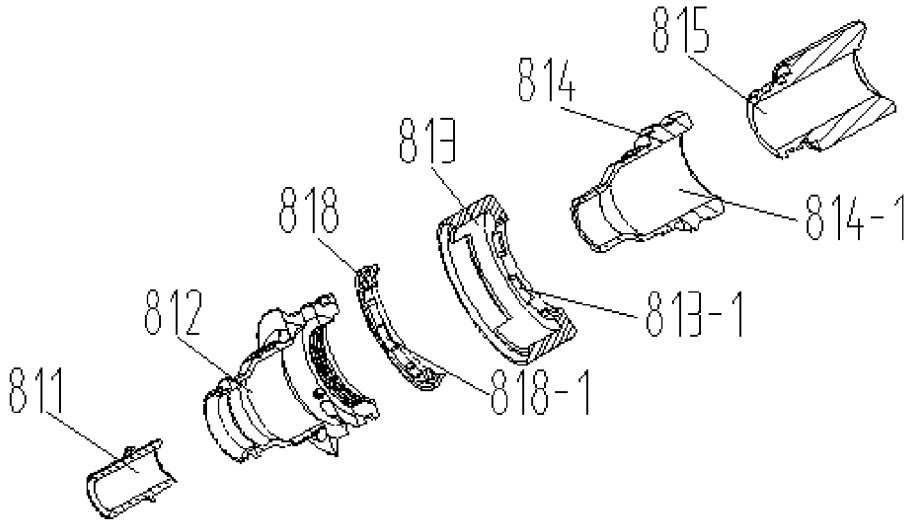
FIG. 17 is a cross-sectional view of the exploded view of an atomizer assembly of the electronic cigarette in FIG. 9.

Referring to FIG. 7, an electronic cigarette having the atomizer according to embodiment 1 or 2 is provided, including a battery assembly 5 mounted at the bottom of the atomizer. Specifically, the cigarette holder 201 of the smoke guiding assembly 2 is connected to the top of the screw cap 20, and the battery assembly 5 is connected to the bottom of the liquid storage tube 401. When the electronic cigarette is in use, the battery assembly 5 supplies power to the atomizer, and the user smokes through the cigarette holder 201. When user is smoking, the air flows into the air guiding gap through the second air inlet groove 221 and the first air inlet groove 141, and then into the inner cavity of the atomizer head 301 through the air guiding groove 231. The air mixed with the smoke flows through the smoke outlet tube 202 and out of the cigarette holder 201.

As can be seen from the above, it is necessary for the user to resist a certain amount of elastic force to press down or pull up the screw cap 20 so that the screw cap 20 engages the upper cover 10 and the screw cap 20 is able to drive the upper cover 10 to rotate. In this way, the elastic locking mechanism 1 is favorable to protect the rotation operation of the upper cover 10. Therefore, the elastic locking mechanism 1, the atomizer having the elastic locking mechanism 1 and the electronic cigarette having the atomizer have a children lock function, which can prevent the upper cover 10 from being removed by a child easily, and prevent the children from touching and eating the tobacco liquid.

Embodiment 4

As shown in FIGS. 8-17, another electronic cigarette is provided, including an atomizer 817 and a main body 816 connected to the atomizer 817. In this embodiment, the atomizer 817 and the main body 816 are removably connected together. According to one implementation of this embodiment, the main body 816 includes a battery assembly 83 and a liquid storage assembly 87 integrated to the battery assembly 83. According to one implementation of this embodiment, both the battery assembly 83 and the liquid storage assembly 87 are arranged inside a housing 85. Specifically, the housing 85 includes a cavity with an open end, the liquid storage assembly 87 is arranged inside the cavity, and the liquid storage assembly 87 is provided with a liquid storage cavity 87-1. Specifically, the liquid storage assembly 87 includes a cup-shaped transparent or semitransparent structure, for example, made of transparent resin or glass. The bottom of the liquid storage cavity 87-1 is closed by the second electrical contact 87-2 to prevent the tobacco liquid from leaking from the bottom of the liquid storage cavity 87-1. A part of the atomizer 817 is arranged inside the liquid storage cavity 87-1, so that the upper end (i.e., the opening end) of the liquid storage cavity 87-1 is closed by the atomizer 817 and the other part of the atomizer 817 is exposed to the outside to form a part of the outer surface of the electronic cigarette. The housing 85 is further provided with a window 820, to help the user to observe the tobacco liquid in the liquid storage cavity 87-1 and determine whether it is required to add or replace the tobacco liquid.

The atomizer 817 includes an atomizer head 810, an atomizing tube 811, a ventilation tube 812, an unlocking component 813, am air inlet and outlet separation tube 814 and an elastic element 818. The lower end of the ventilation tube 812 is removably connected to the atomizer head 810, specifically, by a threaded connection. The unlocking component 813 is sleeved outside the upper end of the ventilation tube 812. The elastic element 818 is sleeved outside the ventilation tube 812, and arranged between the ventilation tube 812 and the unlocking component 813. The inner side of the upper end of the ventilation tube 812 is provided with inner thread, and the air inlet and outlet separation tube 814 is provided with outer thread corresponding to the inner thread of the upper end of the ventilation tube 812. The ventilation tube 812 is connected to the air inlet and outlet separation tube 814 through the inner thread and outer thread, i.e., the ventilation tube 812 is sleeved outside the air inlet and outlet separation tube 814 through the inner thread. One end of the air inlet and outlet separation tube 814 arranged inside the ventilation tube 812 fits closely to the atomizing tube 811. The end of the air inlet and outlet separation tube 814 far away from the atomizing tube 811 is connected to the cigarette holder 815. Specifically, one end of the atomizing tube 811 is communicated to the atomizer head 810 and the other end of the atomizer head 810 fits closely to the air inlet and outlet separation tube 814, so that the smoke created in the atomizer head 810 flows from the atomizing tube 811 through the air inlet and outlet separation tube 814 and the cigarette holder 815 to the mouth of the user. The elastic element 818 is made of an elastic material. In this embodiment, the elastic element 818 is made of rubber or silicon. The elastic element 818 has both elasticity and reliability, with a long serve life.

Further, the air inlet and outlet separation tube 814 is provided with a mounting hole 814-1. One end of the cigarette holder 815 is inserted into the mounting hole 814-1, to facilitate the user to replace the cigarette holder 815.

The ventilation tube 812 is provided with a stop protrusion 812-1, and the elastic element 818 is provided with a blocking groove 818-1 matching the stop protrusion 812-1. The unlocking component 813 is provided with a stop groove 813-1. When the unlocking component 813 and the elastic element 818 are pressed, the elastic element 818 is squashed, the decrease in the thickness of the elastic element 818 reduces the distance between the stop protrusion 812-1 and the stop groove 813-1, and the stop protrusion 812-1 and the stop groove 813-1 engage each other. In this case, the electronic cigarette is in an unlocked state. The unlocked state means that the atomizer 817 may be driven to be separated from other components of the electronic cigarette, such as the main body 816, by continuously applied pressure in combination with other force, such as rotating force, so that operations of adding the tobacco liquid or replacing the atomizer head can be performed. It is known that the positions of the stop protrusion and the stop groove can be exchanged with each other, which brings the same technical effect and is not further described. It is known that, in this embodiment, the ventilation tube 12 is arranged at the opening end of the liquid storage assembly 87 and provided with the stop protrusion 812-1, and the unlocking component 813 is sleeved outside the ventilation tube 812 and provided with the stop groove 813-1, so in this embodiment, the ventilation tube 812 acts as both the upper cover and the lower engagement component, and the unlocking component acts as both the screw cap and the upper engagement component. This shows the ventilation tube 812, the unlocking component 813 and the elastic element 818 forms an elastic locking mechanism together.

Specifically, when the electronic cigarette is in a locked state, the blocking groove 818-1 is sleeved on the stop protrusion 812-1 of the ventilation tube 812, and the upper portion of the elastic element 818 slightly protrudes from the stop protrusion 812-1. In this case, if no downward force is applied on the unlocking component 813, the stop groove 813-1 and the stop protrusion 812-1 are unable to touch or engage with each other, and the atomizer 817 is unable to be separated from the main body 816 since the unlocking component 813 is in an idle position. On the contrary, if the unlocking component 813 is pressed down, the atomizer 817 can be removed through rotating the unlocking component 813. The elastic element 818 is sleeved on the stop protrusion 812-1 through the blocking groove 818-1. Compared with the configuration in which the elastic element 818 is arranged between the upper portion of the ventilation tube 812 and the lower portion of the unlocking component 813, the above configuration has the following advantages: 1) the length of the atomizer 817 is shortened, and the space utilization of the electronic cigarette is increased (e.g., for the electronic cigarettes of the same length, the shorter the atomizer 817 is, the longer the main body 816 is, so the amount of the liquid storage of the main body 816 is increased.); and 2) the user only needs to apply small acting force on the unlocking component 813 to unlock the electronic cigarette, which is convenient for the user to disassemble the atomizer 817.

It will be understood that in other embodiments the positions of the stop protrusion 812-1 and the stop groove 813-1 can be exchanged with each other, i.e., the stop protrusion 812-1 is arranged on the unlocking component 813, the stop groove 813-1 is arranged on the ventilation tube 812, and the blocking groove 818-1 is arranged to match the stop protrusion 812-1.

In this embodiment, the unlocking component 813 is annular-shaped and has the functions of unlocking and adjusting the air intake. It will be understood that the unlocking component 813 can be a component only with a function of unlocking, or a component with the unlocking function and other functions including adjusting the liquid intake, according to the practical production requirements.

Further, the peripheral portion of the ventilation tube 812 close to an upper end of the ventilation tube 812 extends outward to form a convex edge 812-2. The convex edge 812-2 can not only prevent the elastic element 818 from moving downward, but also play a role in shielding. A connection portion 812-3 is formed between a lower end of the ventilation tube 812 and the convex edge 812-2. The outer diameter of the connection portion 812-3 is greater than that of the lower end of the ventilation tube 812. The periphery of the connection portion 812-3 is provided with connection thread. The atomizer 817 is threadedly connected to the main body 816 through the connection thread.

Further, the bottom of the atomizer head 810 is provided with a first electrical contact 810-1 through which the atomizer 817 is electrically connected to the main body 816.

The main body 816 includes a battery assembly 83 and a liquid storage assembly 87 integrated to the battery assembly 83.

The liquid storage assembly 87 is provided with a liquid storage cavity 87-1, a part of the ventilation tube 812 extends into and is received in the liquid storage cavity 87-1, and the atomizer head 810 is also received in the liquid storage cavity 87-1. One end of the liquid storage assembly 87 close to the battery assembly 83 is provided with a second electrical contact 87-2 which is electrically connected to the first electrical contact 810-1 when the atomizer 817 is mounted on the main body 816. The liquid storage assembly 87 further includes a thread ring 89 connected to the housing 85 by an interference fit. The thread ring 89 is threadedly connected to the connection portion 812-3 of the ventilation tube 812 and arranged on the upper end of the liquid storage cavity 87-1. The main body 816 can be threadedly connected to the atomizer 817 through the thread ring 89.

The battery assembly 83 includes a housing 85, a battery 819 disposed in the housing 85, a circuit board assembly support 86 mounted inside the housing 85, a circuit board assembly 84 mounted on the circuit board assembly support 86, a battery gasket 82 arranged at the end of the housing 85 and a battery bottom cover 81 connected to the housing 85 by an interference fit. The thread ring 89 matches the connection thread of the ventilation tube 812, so that the main body 816 is connected to the atomizer 817 by a threaded connection.

It will be understood that in other embodiments, the battery assembly 83 connected to the liquid storage assembly 87 by a threaded connection or a snap fit.

During assembling, the atomizing tube 811 is connected to the air inlet and outlet separation tube 814 by an interference fit, one end of the cigarette holder 815 is inserted into the mounting hole 814-1 of the air inlet and outlet separation tube 814, the elastic element 818 is sleeved on the ventilation tube 812 so that the blocking groove 818-1 engages the stop protrusion 812-1, the unlocking component 813 is arranged on the upper end of the ventilation tube 812, the air inlet and outlet separation tube 814 is connected to the ventilation tube 812 by a threaded connection, and the atomizer head 810 is connected to the ventilation tube 812 by a threaded connection, to form the atomizer 817. The thread ring 89 is connected to the housing 85 by an interference fit. The circuit board assembly 84 is mounted on the circuit board assembly support 86, the leads on the circuit board assembly 84 is welded to the battery 819 and the liquid storage assembly 87, the circuit board assembly 84, the circuit board assembly support 86, the liquid storage assembly 87 and the battery 819 are mounted into the housing 85, and the battery bottom cover 81 is connected to the housing 85 by an interference fit, to assemble as the main body 816.

In use, when it is required to remove the atomizer 817 from the main body 816, the unlocking component 813 should be pressed down (i.e., in a direction towards the main body 816) firstly, and the unlocking component 813 presses the elastic element 818, so that the elastic element 818 is deformed elastically. Then the unlocking component 813 is pressed continually so that the stop groove 813-1 engages the stop protrusion 812-1, and in this case, the atomizer 817 may be rotated with the unlocking component 813 when the unlocking component 813 is rotated. This means that the atomizer 817 may be removed from the maim body 816 only by pressing down and rotating the unlocking component 813 sequentially. In this way, after reading the manual or other information, the adult can know how to remove the atomizer 817 from the main body 816 to add liquid or replace the atomizer head 810. Such operation is simple, without disassembling the large number of parts of the electronic cigarette. Since the atomizer 817 is not removed by simple rotation or press, but a specific combination of rotation and press, and the removing operation should be applied on a specific component (i.e., the unlocking component 813), it is difficult for children to know the process. Thus it can prevent the children from touching and eating the tobacco liquid, and play a good role in protecting children.

During unlocking, when the user stops applying the downward force on the unlocking component 813, the elastic element 818 restores due to its elasticity so that the stop groove 813-1 is disengaged from the stop protrusion 812-1. In this case, the unlocking component 813 is in an idle position, and the atomizer 817 cannot be removed from the main body 816 so that the electronic cigarette goes back to the locked state.

The embodiments are chosen and described in order to explain the principles of the disclosure and their practical application so as to activate others skilled in the art to utilize the disclosure and various embodiments. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. An elastic locking mechanism for an electronic cigarette including a liquid storage assembly provided with an opening end, comprising:

an upper cover removably arranged on the opening end of the liquid storage assembly;

a screw cap sleeved outside the upper cover;

an upper engagement component arranged on the screw cap;

a lower engagement component arranged on the upper cover; and an elastic element mounted between the screw cap and the upper cover to prevent the upper engagement component and the lower engagement component from engaging each other, wherein when the screw cap is pressed down or pulled up, the elastic element is compressed or stretched so that the upper engagement component engages the lower engagement component, and the upper cover is driven to rotate together with the screw cap by rotating the screw cap, so as to open or close the opening end of the liquid storage assembly.

2. The elastic locking mechanism of claim 1, wherein the upper cover includes an upper cover bottom wall and a connection circumference wall formed on the upper cover bottom wall, the connection circumference wall and the upper cover bottom wall form a containing cavity, the screw cap includes a screw cap top wall, a screw cap outer circumference wall formed on an outer circumference of the screw cap top wall, and a screw cap inner circumference wall formed on a bottom surface of the screw cap top wall, and an annular space is formed between the screw cap outer circumference wall and the screw cap inner circumference wall.

3. The elastic locking mechanism of claim 2, wherein the upper engagement component is fixedly arranged in the annular space of the screw cap, the lower engagement component is fixedly arranged in the accommodating cavity of the upper cover, a bottom surface of the upper engagement component is provided with at least one fixing block, a top surface of the lower engagement component is provided with at least one fixing groove matching the at least one fixing block, alternatively, the top surface of the lower engagement component is provided with at least one fixing block, and the bottom surface of the upper engagement component is provided with at least one fixing groove matching the at least one fixing block.

4. The elastic locking mechanism of claim 3, wherein a length of the fixing groove in an arc direction is greater than or equal to a length of the fixing block in an arc direction.

5. The elastic locking mechanism of claim 2, wherein the upper cover further includes an upper cover circumference edge formed on a top side of the connection circumference wall and extending outward, and a top circumference wall formed vertically on a top surface of the upper cover circumference edge, the upper engagement component is fixedly arranged in the annular space of the screw cap, the lower engagement component is fixedly arranged on the upper cover circumference edge, and the lower engagement component is sleeved outside the upper engagement component, a bottom end of a circumference wall of the upper engagement component is provided with a circumferential edge extending outward, the circumferential edge is provided with at least one fixing block protruding upward, a top end of the lower engagement component is provided with an annular cover top wall, and the cover top wall is provided with at least one projection protruding downward.

6. The elastic locking mechanism of claim 3, wherein one end of the elastic element is fixedly arranged on the screw cap inner circumference wall, and another end of the elastic element abuts against a top surface of the upper cover bottom wall at installation, alternatively, one end of the elastic element is fixedly arranged on the top surface of the upper cover bottom wall, and another end of the elastic element abuts against the screw cap inner circumference wall at installation.

7. The elastic locking mechanism of claim 1, wherein the upper cover is provided with at least one first air inlet groove, the screw cap is provided with at least one second air inlet groove, and the at least one first air inlet groove is gradually aligned or staggered with the at least one second air inlet groove when the screw cap is rotated with respect to the upper cover.

8. The elastic locking mechanism of claim 7, wherein an outer circumference surface of the upper cover is provided with a convex column extending into the second air inlet groove, a width of the second air inlet groove in an axial direction is greater than a diameter of the convex column.

9. The elastic locking mechanism of claim 1, further including a ventilation tube and an unlocking component, wherein the upper cover and the lower engagement component are integrated to form the ventilation tube, the screw cap and the upper engagement component are integrated to form the unlocking component, the ventilation tube is provided with a stop protrusion/groove, and the unlocking component is provided with a corresponding stop groove/protrusion.

10. The elastic locking mechanism of claim 9, wherein the ventilation tube is provided with the stop protrusion, the elastic element is provided with a blocking groove matching the stop protrusion such that the elastic element is sleeved outside the ventilation tube.

11. The elastic locking mechanism of claim 9, wherein the elastic element is made up of rubber or silicone.

12. An atomizer, comprising the elastic locking mechanism of claim 1.

13. The atomizer of claim 12, further comprising a smoke guiding assembly, an atomizing assembly and a liquid storage assembly, wherein the atomizing assembly is arranged in an inner cavity of the liquid storage assembly, the elastic locking mechanism is removably arranged on the liquid storage assembly, one end of the elastic locking mechanism is connected to the smoke guiding assembly, and the other end of the elastic locking mechanism is connected to the atomizing assembly.

14. The atomizer of claim 13, wherein the upper cover is integrally connected to a connection tube with an outlet end opposed to the upper cover, the outlet end of the connection tube is connected to the atomizing assembly, the smoke guiding assembly includes a smoke outlet tube and an air inlet tube, the smoke outlet tube extends into the connection tube through the top of the screw cap, the air inlet tube is mounted at the outlet end of the connection tube and sleeved on the smoke outlet tube, the air inlet tube communicates a channel of the smoke outlet tube with an inner cavity of the atomizing assembly, an air guiding gap is formed between an outer circumference wall of the smoke outlet tube and an inner circumference wall of the connection tube, an outer circumference surface of the air inlet tube is provided with at least one air guiding groove, and the air guiding groove communicates the air guiding gap with the inner cavity of the atomizing assembly.

15. The atomizer of claim 13, wherein the atomizing assembly includes an atomizer head with a heating element inside, the liquid storage assembly includes a liquid storage tube and a conductive base arranged at the bottom of the liquid storage tube, the atomizer head is arranged inside the liquid storage tube, a liquid storage space is formed between an inner circumference wall of the liquid storage tube and an outer circumference wall of the atomizer head, and the conductive base is electrically connected to the heating element.

16. The atomizer of claim 12, wherein the atomizer further includes an atomizer head, an atomizing tube, a ventilation tube, an unlocking component and an inlet and outlet separation tube, the upper cover and the lower engagement component are integrated to form the ventilation tube, the screw cap and the upper engagement component are integrated to form the unlocking component, a lower end of the ventilation tube is removably connected to the atomizer head, the unlocking component is sleeved outside an upper end of the ventilation tube, the ventilation tube is sleeved outside the inlet and outlet separation tube, one end of the atomizing tube is communicated to the atomizer head, and the other end of the atomizing tube fits the inlet and outlet separation tube tightly.

17. An electronic cigarette, comprising a liquid storage assembly with an opening end, and the atomizer of claim 12.

18. The electronic cigarette of claim 17, further comprising a housing and a battery assembly, wherein both the battery assembly and the liquid storage assembly are arranged inside the housing, the liquid storage assembly is provided with a liquid storage cavity, and a part of the atomizer is arranged inside the liquid storage cavity.

19. The electronic cigarette of claim 18, a bottom of the atomizer is provided with a first electrical contact, and the liquid storage assembly is provided with a second electrical contact electrically connected to the first electrical contact.

* * * * *